United States Patent [19]

Wedler

[11] 3,962,933

[45] June 15, 1976

[54] DRIVE SYSTEM, PARTICULARLY FOR SHIPS

[75] Inventor: Herbert Wedler, Witten, Germany

[73] Assignee: Mannesmann Aktiengesellschaft, Dusseldorf, Germany

[22] Filed: Jan. 27, 1975

[21] Appl. No.: 544,189

[30] Foreign Application Priority Data

Feb. 1, 1974 Germany ..... 2405419
Feb. 15, 1974 Germany ..... 2407981

[52] U.S. Cl. ..... 74/665 GA; 64/1 C; 64/27 NM; 192/85 AB; 192/106.1

[51] Int. Cl.[2] ..... F16H 37/06; F16D 3/70; F16D 13/32

[58] Field of Search..... 74/665 GA; 64/1 C, 1 V, 64/27 NM; 192/70, 85 AB, 106.1

[56] References Cited

UNITED STATES PATENTS

| | | | |
|---|---|---|---|
| 3,727,431 | 4/1973 | Yokel | 64/27 NM |
| 3,777,865 | 12/1973 | Walter | 192/106.1 X |
| 3,791,497 | 2/1974 | Fleischmann et al. | 64/27 NM X |
| 3,813,897 | 6/1974 | Hiersig et al. | 64/27 NM X |

*Primary Examiner*—Allan D. Herrmann
*Attorney, Agent, or Firm*—Ralf H. Siegemund

[57] ABSTRACT

The drive system includes a motor or engine whose output shaft is connected to the input shaft of a transmission, e.g. speed reducing gear, via an elastic coupling and a clutch, in that order. The input element of the coupling sits directly on the motor or engine shaft; the output element (ring) of the coupling is suspended in cardan fashion, possibly together with the input element of the clutch, by means of an additional elastic coupling which has one part secured to the clutch input and the other part is connected either to a bell shaped structure which is journalled in the transmission casing or to the output element of the motor coupled coupling. The two parts of the additional coupling are interconnected through annularly arranged elastic sleeves. The bell shaped structure can be used in either case, and extends from a hollow shaft being traversed by the transmission shaft and driving auxiliary equipment independantly from the operational state of the clutch.

24 Claims, 2 Drawing Figures

DRIVE SYSTEM, PARTICULARLY FOR SHIPS

BACKGROUND OF THE INVENTION

The present invention relates to heavy duty drive systems e.g. for ships and move particularly to improvements in such systems which include a drive engine or motor, a transmission gear, e.g. a reducing gear, an elastic coupling and interconnect means between the transmission gear input shaft and the motor or engine output shaft.

A drive system of that type is for example disclosed in U.S. Pat. No. 3,669,230. The system serves in particular for occasionally driving the propellor shaft of the ship via a resilient clutch, but an auxiliary generator is continuously driven via a power and torque branching system included in the transmission path from the engine to the reducing gear. The resilient clutch has an inner ring as rotary output which is seated on a pinion (input) shaft for the reducing gear, whose output drives the propellor. The clutch is used for power branching to obtain the aforementioned dual drive function. This branching train includes also an elastic coupling having concentric input and output parts which are interconnected by means of a rubber elastic element.

The present invention, therefore, relates also to improvements in a torque transmission system which permits such power branching. A heavy duty system of that kind has bearings for the engine or motor shaft and bearings for the transmission shafts, gears, etc. The interconnect system between them must be supported by one or the other. The known systems require that the motor or engine shaft and its bearings support the interconnect structure between transmission and motor or engine to a considerable extent. As to this it has to be observed, that some or even significant radial displacement may occur between reducing gear and motor shaft. Such radial displacements between engine and reducing gear will be observed when the motor or engine itself is elastically mounted or if the foundation itself has some degree of softness. Another cause for such a displacement is to be seen in thermal expansion of the engine frame or mount and of the casing for the reducing gear (in which the gears and shafts are journalled). If the engine has a crank shaft, radial displacements between it and the gear may become particularly disturbing. It is necessary that such displacement does not affect, or very little, the motor or engine shaft bearings.

DESCRIPTION OF THE INVENTION

It is an object of the present invention to improve a heavy duty drive and torque transmission system such as used for ships and which permits displacement between the motor or engine shaft, and the input shaft of the transmission system without affecting the motor or engine shaft.

It is a specific object of the present invention to relieve the motor or engine shaft and its bearings of a drive system, e.g. for ships from supporting coupling elements as interposed between that shaft and a transmission reducing gear.

In accordance with the preferred embodiment of the invention it is suggested to provide for suspension and support of a resilient shift clutch through direct or indirect journalling thereof on the casing of the transmission gear, and to support the output element of an elastic i.e. resilient coupling by the clutch without journalling on or in relation to the motor shaft except through the resilient connection in that coupling whose input is connected to and supported by the motor or engine output shaft.

It is a specific feature of the invention to provide for cardan mount like suspension of the output element of the coupling using an additional elastic resilient coupling which has plural, annularly arranged resilient elements and by means of which this output element of the coupling is suspended by and from or through connection with the input element of the clutch. This way, additional degrees of freedom are provided for the output element of the coupling whose input is connected directly to the motor or engine shaft, so that displacements between that shaft and the input shaft for the transmission gear are taken up by the double cardan mount as established by combined action of the elastic part or parts of the elastic coupling as well as by the plural elastic elements of the additional coupling.

In one form of practicing the invention, the additional elastic coupling is interposed between the output of the motor coupled coupling and the input element of the clutch. This way, torsional oscillations are additionally kept from the motor or engine. The input element of the clutch is rigidly secured to a bell shaped or dish shaped element that is journalled on the transmission shaft or the transmission casing. Since the transmission shaft is journalled in the transmission casing, one can also say that this bell or dish shaped element is either directly or indirectly journalled to the casing. Specifically, in the latter case, the bell or dish shaped element is secured to a hollow shaft for driving it; this hollow shaft is traversed by the transmission input shaft; is separately journalled in the casing; and is connected to a gear for transmission of rotational power to an auxiliary equipment shaft. The suspension of the clutch input on a journalled hollow shaft by means of rigid connection to and with a bell shaped structure is a feature having its own significance particularly with regard to the journalling and support of the input element for the clutch. Even without additional elastic coupling, none of the clutch parts nor the output of the motor coupled coupling will bear on the motor or engine shaft.

In accordance with another form of practicing the invention, the input element of the clutch is connected through the additional elastic coupling to a bell shaped structure which is either journalled in the casing or on the transmission shaft; i.e. either directly or indirectly journalled in the casing because the transmission shaft itself is journalled in the casing also here. The output element of the motor coupled coupling and the input element of the clutch may be rigidly interconnected in that case and are, therefore, cardanically suspended together.

The elastic elements of the additional coupling are preferably arranged in a circle which is larger than the circle along which elastic elements are arranged inside of the resilient shift clutch. The several elastic elements are preferably rubber elastic sleeves, held in an annulus which is secured to the input element of the clutch and which are traversed by bolts leading to a disk which is either secured to the output element of the motor coupled coupling or to the bell shaped structure.

DESCRIPTION OF THE DRAWINGS

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

Figure 1:
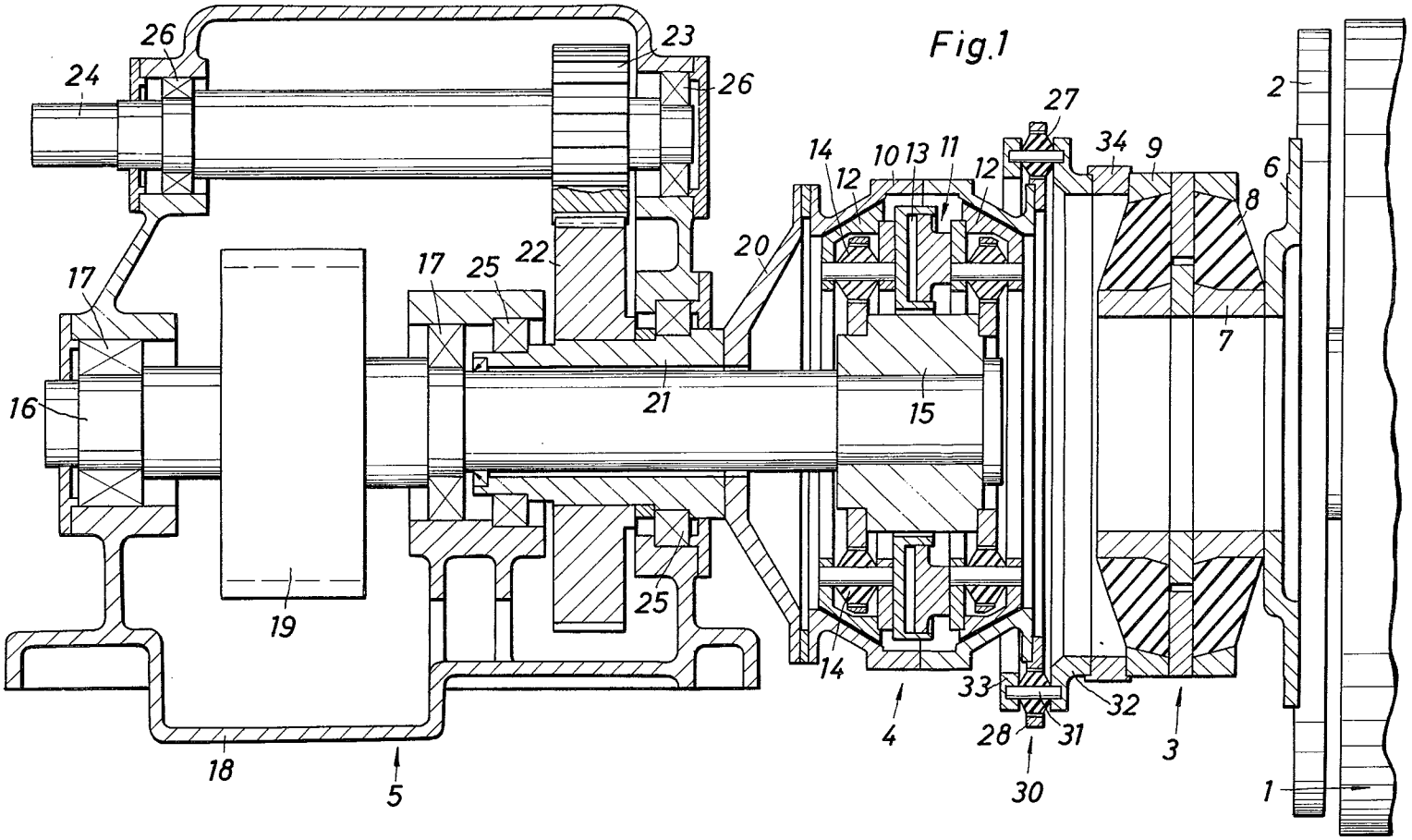
FIG. 1 is a cross-section through a drive system showing a first example for the preferred embodiment of the invention, wherein particularly the intermediate coupling is interposed in the power and torque transmission path from an elastic coupling to the elastic clutch.

Proceeding now to the detailed description of the drawings, the elements common in both examples shall be described first. The system includes in both cases a motor or engine 1 having a rotor output flange 2 which is connected directly to the motor shaft and supported by the shaft bearing, accordingly. The input of an elastic coupling 3 which is not of the connect-disconnect type, is secured to flange 2. The output of coupling 3 in turn drives a resilient connect-disconnect or shift clutch 4 whose output in turn is connected to drive a speed reducing gear 5, serving as transmission gear to the load proper, which is a propellor shaft (not shown).

The clutch 4 has a driving output established by a ring or annulus 15 which sits on the pinion shaft 16, the latter being the input shaft for the reducing gear 5. The gear 5 includes a casing 18, and pinion shaft 16 is journalled in the casing by means of suitable bearings 17. Shaft 16 carries a pinion which meshes a gear (not shown) which in turn is drivingly connected to the propellor shaft (not shown, see for example, U.S. Pat. No. 3,669,230).

A secondary output shaft 24 is journalled by means of bearings 26 in an extension of the casing 18. This shaft is provided, for example, to drive a generator and/or other auxiliary equipment. Shaft 24 carries a pinion gear 23 which is driven by a gear 22.

Gear 22 is secured to a hollow shaft 21 which is also journalled in casing 18 by means of bearings 25. Shaft 21 is concentric to shaft 16 and the latter traverses the former with play, so that shafts 21 and 16 can rotate independantly from each other. It should be noted however, that shaft 21 could be journalled on shaft 16, so that shaft 21 would be journalled indirectly in casing 18 in such a case. In any event, the shafts 16 and 21 are journalled for independent but concentric or coaxial rotation. Moreover, both shafts are driven from clutch 4 serving as a power branching device, in that the primary input of the shift clutch provides also the rotational (continuous) input for shaft 21, while shaft 16 requires an engaged clutch for rotation through the power, as applied to and transmitted by the clutch.

Also in both Figures, coupling 3 has an inner ring 7 and an outer ring 9, and these rings are interconnected by a rubber elastic layer or elements 8. The coupling as such is the same in both Figures, but input and output connections differ. Nevertheless, the input element of the resilient coupling 3 is connected directly (and supported by) the motor or engine shaft. The output or driving part of coupling 3 is not journalled on or otherwise connected to the motor or engine shaft except through the resilient means 8.

FIG. 1 shows a predominantly flat annulus 6 actually having axially displaced inner and outer flanges. The outer flange connects to motor flange 2 while the inner flange is connected to annulus 7. Thus, ring 7 in Figure 1 is the input of coupling 3. The output of the coupling is provided via annulus 9 to which is connected a ring 34; further connections are made through that ring.

Figure 2:
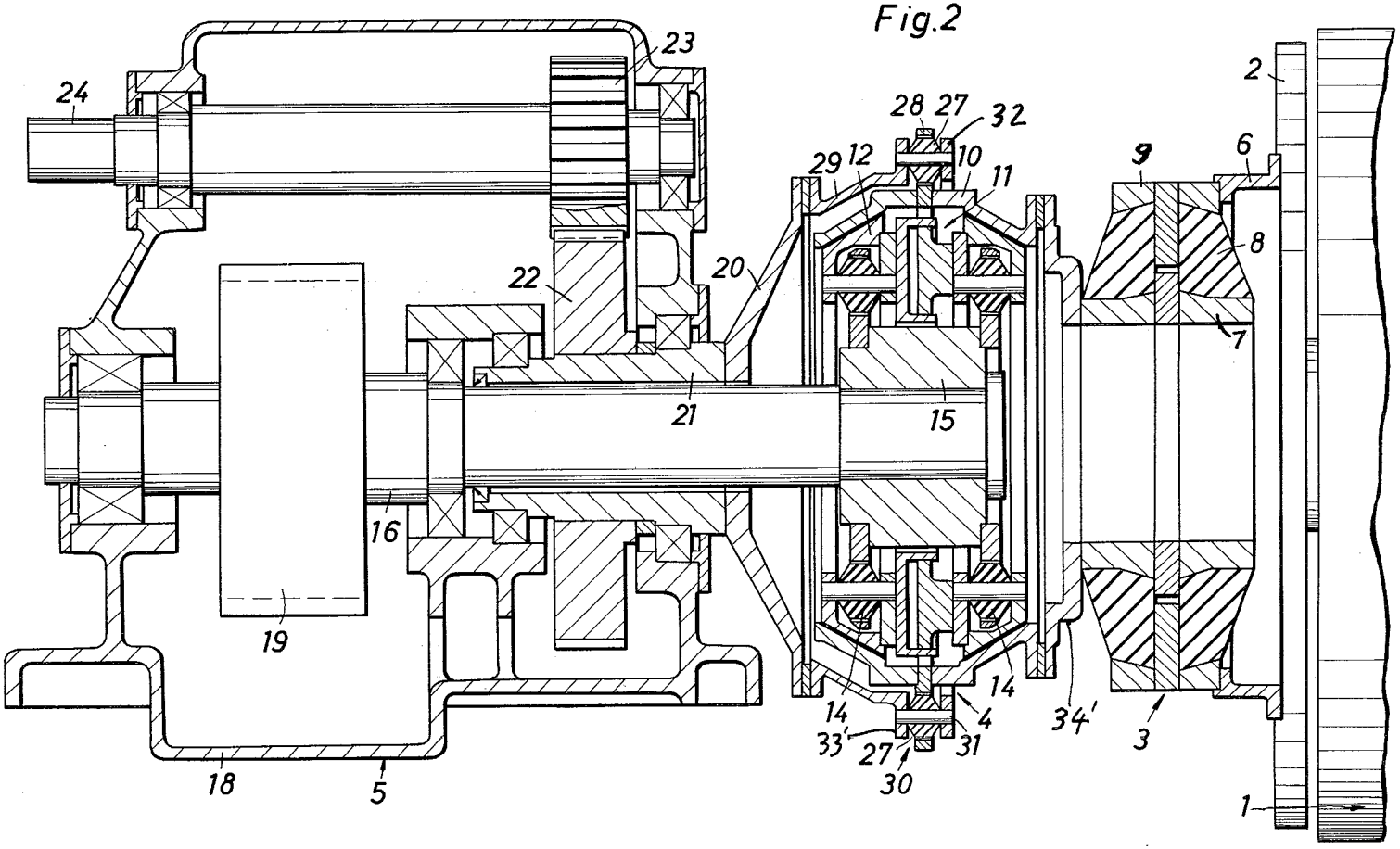
FIG. 2 is a similar view but showing the intermediate coupling as cardan suspension for the input of the clutch as well.

FIG. 2 shows a predominantly cylindrical element 6', having axial end flanges respectively secured to motor flange 2 and to the outer ring 9 of the coupling 3. Hence, the input for the coupling is provided here through the outer annulus or ring 9. A predominantly flat annulus 34' serves here as output connector for the coupling taking the output from inner ring 7.

It should be mentioned, that these particular input-/output connections of the coupling 3, shown in FIGS. 1 and 2, provide one distinction among these figures which, however, is unrelated to the other distinguishing features and can, therefore, be used interchangeably. As to details for a coupling see for example, U.S. Pat. Nos. 3,813,897 and 3,719,060.

In both Figures, clutch 4 is constructed as a pneumatically operated, elastic-resilient, double cone, friction clutch. The clutch has an outer, driving portion 10 constructed as short cylinder casing with two conical ends. Conicity as to the outer surface is not essential (but convenient). Decisive is that the internal surfaces of element 10 have conical contour. The driven part, element 11 of the clutch, is comprised of two conical members 12 having friction lining for frictional engagement with the said conical inner surfaces of the two conical portions of part 10.

The two parts 12 are axially displaceable with respect to each other for engagement with and disengagement from part 10. The two parts 12 are constructed to provide for an annular, piston-cylinder arrangement 13 which when pressurized causes the parts 12 to spread axially for clutch engagement. Upon venting the piston chamber, the clutch parts disengage. Parts 12 and 13 constitute the or part of the operating means for this shift clutch. For details of a double cone friction clutch see also the above mentioned U.S. Pat. No. 3,669,230, but see also U.S. Pat. Nos. 3,708,048 and 3,804,220.

Parts 12 are mounted to inner ring 15 of clutch 4 by means of resilient members 14 which permit axial displacement of parts 12 but both of them are always drivingly connected to ring 15. These resilient-elastic elements are constructed as sleeves which are inserted in apertures of disks which in turn are secured to annulus 15. The sleeves are traversed by bolts which are secured to the driven clutch parts 12. For construction see also for example, U.S. Pat. No. 3,804,220.

As was stated above, ring or annulus 15 sits on pinion shaft 16 and upon engagement of the clutch 4, the shaft is driven. Both Figures show also, of course, a driving connection between the output of the coupling 3 and the input (10) of clutch 4. Also in both Figures, the output of the coupling 3 is mounted in cardan like suspension, by means of peripherally arranged elasticresilient elements 27 establishing an intermediate coupling 30. These elastic elements are connected to the input element 10 of the clutch in either case, though particulars differ.

Elements 27 are known, rubber elastic sleevespring elements, i.e. they consist of annular rubber sleeves traversed by a bolt 31. Actually, the clutch elements 14 are of similar construction (see e.g. U.S. Pat. No. 3,804,220).

Proceeding now to the description of the differences between the Figures, I turn first to FIG. 1. As was mentioned already, in this particular example outer annulus 9 is the driving output of the coupling 3 and that annulus is to be cardanically suspended as per the rule of this invention. The driving input annulus 7 of coupling 3 is rigidly flanged to the motor flange 2.

The intermediate coupling 30 is interposed between coupling 3 and clutch 4, or, more specifically, in the power and torque transmission path between coupling output 9 and clutch input 10. Coupling 30 has a carrier annulus 28 with apertures along the periphery in which are inserted the rubber sleeves 27. The bolts 31 traversing the elastic elements 27 are connected to two rings or disk 32, 33; constituting the input portion of that additional coupling; 28 is the output thereof.

The annulus 34 is secured to both, coupling output 9 and ring 32 (and ring 33 is bolted to ring 32). Now it should be observed that clutch part or input element 10 is connected additionally to hollow shaft 21 by means of a bell or dish shaped disk 20. That connection is a rigid one. Since shaft 21 is journalled in casing 18, disk 20 and part 10 is journalled therewith.

As far as the invention, in the broader sense, is concerned it is of importance that the combination structure 20–21 is journalled in casing 18 by means of bearings 25. Therefore, clutch part 10 is journalled also in casing 18 by this connection. Moreover, coupling part 9 is suspended from clutch part 10 by means of the additional coupling 30 so that these parts are also journalled in transmission casing 18, and not on or by the motor or engine shaft journal. It is particularly advantageous, that this journal support for clutch part 10 and coupling part 9 is also useable directly to obtain power branching for driving the propellor and auxiliary equipment. It follows further, that coupling annulus 9 is supported only through resilient elements. Once by connection to inner ring 9 via elastic elements 8; and additionally by cardanic suspension through the resilient elements 27 on clutch part 10.

The motor or engine torque is transmitted by this system as follows. Motor 1 drives its flange 2 which in turn drives disk 6 and torque is transmitted from there via annulus 7, elastic elements 8, annulus 9, ring 34, coupling 30 to clutch input part 10. The clutch branches the power and torque. A permanent connection and torque transmission is provided through disk 20 to hollow shaft 21 driving auxiliary equipment shaft 24 via gears 22, 23. Upon engagement of the clutch 4, torque is additionally transmitted from part 10 to clutch part 11 driving shaft 16 which in turn will drive the propellor shaft via gear 19.

Should shaft 16 be displaced (oscillatorily or otherwise) relative motor flange 2, the various resilient elements 8, 14 and 27 will take up such displacement an relieve particularly the bearings for either shaft, including also the bearings 25, from such asymmetry.

Turning now to distinctive particulars of FIG. 2, the coupling 3 has its outer ring 9 connected to motor flange 2 via cylinder element 6', while the inner ring 7 provides the driving output. In this example then it is this inner ring that is being cardanically suspended. Moreover, the cardan suspension includes also the clutch part 10.

FIG. 2 shows also the disk 20 which is secured to the journalled hollow shaft 21. Another bell shaped element 29 is axially flanged to the large end of disk 20, and element 29 has an axial end flange 33' performing the analogous function as ring 33 in FIG. 1, as far as the intermediate coupling 30 is concerned. No direct (rigid) connection between parts 20, 21 and clutch part 10 exist, but the elastic coupling elements 27 are interposed. Nevertheless, clutch input element 10 is suspended from the bell shaped structure 20, 29 and journalled therewith in the casing 18.

The elastic elements 27 in this construction are held in the peripherally arranged apertures of a disk 28' which is interposed in axially split portions of clutch part 10, being secured to both of them. The disk 28' is specifically disposed in the plane which includes the cardan pivot for the clutch. The plane of course extends transverse to the axis of rotation of the clutch and coupling system. The other disk 32, of coupling 30 is bolted to disk 33' as before.

The cardan mount and suspension is completed by rigid connection between annulus 7 and clutch part 10 under interpositioning of the disk 34'. The cardan mount for parts 7 and 10 (including 34') is, therefore, constituted also here by the elastic-resilient layer 8 of the coupling 3 and by the elastic-resilient elements 27 of coupling 30.

The power and torque branching occurs also in this example, except that the permanent connection between part 10 (as driven via coupling 3) and hollow shaft 21 runs through the resilient elements of the intermediate coupling 30. That coupling 30 is not effective in the path for transmission of torque to the pinion and propellor shafts.

It should be noted, that the elements 27 are arranged in both examples along a circle having a diameter which is larger than the diameter of the circles along which clutch elements 14 are arranged.

The invention is not limited to the embodiments described above but all changes and modifications thereof not constituting departures from the spirit and scope of the invention are intended to be included.

I claim;

1. In a drive system for example for ships having a motor or engine with output shaft, further having a transmission gear with input shaft and being disposed in a casing, there being a clutch interposed between said shafts for causing the input shaft of the gear to be selectively driven from the said output shaft, the clutch having an input element and an output element connected to said input shaft and operating means for selectively connecting the input element of the clutch to the output element thereof, the improvement comprising:

a first coupling having an input element connected to said output shaft and an output element connected to the input element of the first coupling by elastic means;

first means for journalling the clutch input element to said casing to be supported therein;

second means for connecting the clutch input element to the output element of the first coupling; and one of the first and second means constructed as an additional elastic coupling which includes peripherally distributed elastic elements so that at least the first coupling output element is mounted in cardan suspension fashion by operation of the elastic means of the first coupling and by the elastic elements of said additional coupling.

2. In a drive system as in claim 1, wherein the one means includes a disk secured to the input element of the clutch, elastic elements being disposed in apertures arranged along the periphery of that disk.

3. In a drive system as in claim 2, the operating means including plural resilient elements arranged aroung the axis along a circle having smaller diameter than the circle along which said elastic elements of said additional clutch are arranged.

4. In a drive system as in claim 3, said elastic and resilient elements being rubber elastic sleeves inserted in the apertures of said disk.

5. In a drive system as in claim 2, said elastic elements being rubber elastic sleeves inserted in the apertures of said disk.

6. In a drive system as in claim 5 and including a first disk and a second disk interconnected by bolts traversing said sleeves.

7. In a drive system as in claim 6, wherein one of said disks is connected to said output element of said coupling, the one means being the second means.

8. In a drive system as in claim 6, wherein one of said disks is secured to a bell shaped disk, the one means being the first means which includes means for journalling the disk in the casing.

9. In a system as in claim 1, the first means being constructed to include the additional elastic coupling, the second means providing for rigid connection between the clutch input element and the output element of the first coupling.

10. In a system as in claim 9, the first means including a hollow shaft traversed by said input shaft of said transmission gear, and a bell shaped structure secured to said hollow shaft, the additional coupling being interposed between the input element of the clutch and the bell shaped structure.

11. In a system as in claim 10, the additional coupling including a disk with peripherally arranged resilient elements, the disk being secured to and envelopes the input part of the clutch.

12. In a system as in claim 11, the resilient elements being rubber sleeves held in the disk and traversed and being held by bolts secured to the bell shaped structure.

13. In a system as in claim 11, wherein power and torque is derived from the hollow shaft.

14. In a system as in claim 1, the second means being constructed as the additional elastic coupling by means of which the output element of the first coupling is connected to the input element of the clutch.

15. In a system as in claim 14, the first means including a bell shaped structure journalled to the casing and rigidly secured to the input element of the clutch.

16. In a system as in claim 15, the first means including a hollow shaft receiving the input shaft for the transmission gear, the bell shaped structure being secured to the hollow shaft.

17. In a system as in claim 16, the hollow shaft being provided for power and torque branching.

18. In a system as in claim 14, the additional elastic coupling including a disk secured to said input element of the clutch, plural rubber sleeves inserted in peripherally arranged apertures in the disk, the sleeves being traversed by bolts bolted to a disk which is secured to the output element of the first coupling.

19. In a drive system for example, for ships having a motor or engine with output shaft further having a transmission gear with input shaft and being disposed in casing, there being a clutch interposed between said shafts for causing the input shaft of the gear to be selectively driven from said output shaft, the clutch having an input and an output element connected to said input shaft and operating means for selectively connecting the input element of the clutch to the output element thereof, there being additionally a hollow shaft journalled in the casing by bearing means and provided with output gearing for connection to auxiliary equipment, the improvement comprising:

a first coupling having an input element connected to said output shaft, and an output element connected to the input element of the first coupling by elastic means included in the first coupling;

first means secured to the hollow shaft and connected to the input element of the clutch to receive rotary power therefrom and to support the input element of the clutch; and second means for interconnecting the input element of the clutch and the output element of the first coupling, so that the latter is supported by the former and exclusively through journal support in the casing, independently from the motor or engine and its shaft journals and bearings, the motor shaft being connected to the clutch, to the transmission shaft and to the hollow shaft through the elastic means of the first coupling without any other rigid connection bearing on the motor or engine shaft.

20. In a system as in claim 19, wherein the first means includes also rigid connection to the input element of the clutch, so that the input element of the clutch is rigidly connected to the hollow shaft and supported by the bearings for the latter shaft.

21. In a system as in claim 20, wherein the second means includes an additional elastic coupling to obtain a cardan suspension of the output element of the first coupling.

22. In a system as in claim 20, wherein the first means includes a bell shaped structure whose arrow portion is secured to the hollow shaft and whose wide portion is secured to the input element of the clutch.

23. In a system as in claim 19, wherein the first means includes an elastic additional coupling, the second means being a rigid connection so that the input element of the clutch and the output element of the first coupling are mounted in cardan fashion to and for support by the hollow shaft and its bearings.

24. In a system as in claim 23, wherein the first means includes a bell shaped structure whose narrow end is secured to the hollow shaft and whose wide end is connected to the additional coupling, the latter being interposed between said wide end and the input element of the clutch.

* * * * *